US007369965B2

(12) United States Patent
Mylaraswamy et al.

(10) Patent No.: US 7,369,965 B2
(45) Date of Patent: May 6, 2008

(54) SYSTEM AND METHOD FOR TURBINE ENGINE ANOMALY DETECTION

(75) Inventors: Dinkar Mylaraswamy, Fridley, MN (US); Onder Uluyol, Fridley, MN (US); Charles M. Ball, Gilbert, AZ (US)

(73) Assignee: Honeywell International, Inc., Morristown, NJ (US)

( * ) Notice: Subject to any disclaimer, the term of this patent is extended or adjusted under 35 U.S.C. 154(b) by 313 days.

(21) Appl. No.: 10/880,059

(22) Filed: Jun. 28, 2004

(65) Prior Publication Data

US 2005/0283909 A1 Dec. 29, 2005

(51) Int. Cl.
*A47G 9/06* (2006.01)

(52) U.S. Cl. ..... 702/185

(58) Field of Classification Search ..... 702/185
See application file for complete search history.

(56) References Cited

U.S. PATENT DOCUMENTS

| | | | | |
|---|---|---|---|---|
| 3,582,928 | A | 6/1971 | Gaertner | |
| 4,406,169 | A | 9/1983 | Ikeuchi et al. | |
| 4,460,893 | A | 7/1984 | Thomas et al. | |
| 4,471,444 | A | 9/1984 | Yee et al. | |
| 4,635,210 | A | 1/1987 | Shiohata et al. | |
| 5,309,379 | A | 5/1994 | Rawlings et al. | |
| 5,467,355 | A | 11/1995 | Umeda et al. | |
| 5,550,737 | A | 8/1996 | Tedeschi | |
| 5,628,229 | A | 5/1997 | Krone et al. | |
| 5,748,500 | A | 5/1998 | Quentin et al. | |
| 6,063,129 | A * | 5/2000 | Dadd et al. | 703/7 |
| 6,195,624 | B1 | 2/2001 | Woodman et al. | |
| 6,208,953 | B1 | 3/2001 | Milek et al. | |
| 6,226,597 | B1 | 5/2001 | Eastman et al. | |
| 6,439,767 | B1 | 8/2002 | Badeer | |
| 6,711,952 | B2 | 3/2004 | Leamy et al. | |
| 2003/0040878 | A1 * | 2/2003 | Rasmussen et al. | 702/85 |
| 2004/0030417 | A1 * | 2/2004 | Gribble et al. | 700/29 |

FOREIGN PATENT DOCUMENTS

GB 2 374 904 * 10/2002

OTHER PUBLICATIONS

B. De Schutter and B. De Moor (The singular value decomposition and QR decomposition in the extended max algebra, Mar. 1995), Technical report Jun. 1995, p. 1-23.*
http://www.m-w.com/dictionary/combine, p. 1.*
http://mw1.merriam-webster.com/dictionary/matrix, p. 1-2.*

* cited by examiner

*Primary Examiner*—Tung S. Lau
(74) *Attorney, Agent, or Firm*—Ingrassia, Fisher & Lorenz, P.C.

(57) ABSTRACT

A system and method is provided for detecting anomalies in turbine engines emanating from the main shaft and/or main shaft bearings. The anomaly detection system includes a sensor data processor and a matrix analysis mechanism. The sensor data processor receives engine sensor data, including main engine speed data during spin down, and formats the engine sensor data into an appropriate matrix. The matrix analysis mechanism receives the sensor data matrix and performs a singular value analysis on the sensor data matrix to detect potential anomalies in the turbine engine main shaft and/or bearings. The output of the matrix analysis mechanism is passed to a diagnostic system where further evaluation of the anomaly detection determination can occur.

30 Claims, 5 Drawing Sheets

SYSTEM AND METHOD FOR TURBINE ENGINE ANOMALY DETECTION

FIELD OF THE INVENTION

This invention generally relates to diagnostic systems, and more specifically relates to diagnostic systems for turbine engines.

BACKGROUND OF THE INVENTION

Modern mechanical systems can be exceedingly complex. The complexities of modern mechanical systems have led to increasing needs for automated prognosis and fault detection systems. These prognosis and fault detection systems are designed to monitor the mechanical system in an effort to predict the future performance of the system and detect potential faults. These systems are designed to detect these potential faults such that the potential faults can be addressed before the potential faults lead to failure in the mechanical system.

One type of mechanical system where prognosis and fault detection is of particular importance is aircraft systems. In aircraft systems, prognosis and fault detection can detect potential faults such that they can be addressed before they result in serious system failure and possible in-flight shutdowns, take-off aborts, delays or cancellations.

Modern aircraft are increasingly complex. The complexities of these aircraft have led to an increasing need for automated fault detection systems. These fault detection systems are designed to monitor the various systems of the aircraft in an effort to detect potential faults. These systems are designed to detect these potential faults such that the potential faults can be addressed before the potential faults lead to serious system failure and possible in-flight shutdowns, take-off aborts, delays or cancellations.

Turbine engines are a particularly critical part of many aircraft. Turbine engines are commonly used for main propulsion aircraft. Furthermore, turbine engines are commonly used in auxiliary power units (APUs) that are used to generate auxiliary power and compressed air for use in the aircraft. Given the critical nature of turbine engines in aircraft, the need for fault detection in turbine engines is of extreme importance.

Traditional fault detection systems for turbine engines have been limited in their ability to detect the occurrence of anomalies in the bearings and main shaft of the turbine engine. Deformations in the shaft can lead to problems in the bearings, and likewise, problems in the bearings can lead to failures in the shaft. In all cases, defects in the shaft and/or bearings can cause severe performance problems in the turbine engines. Unfortunately, detection methods have been unable to suitably detected anomalies in the main shaft and bearings with sufficient accuracy based on the limited data sets available for fault detection.

Thus, what is needed is an improved system and method for detecting anomalies in turbine engine main shafts and bearings that can consistently detect anomalies and the problems that result from limited data sets.

BRIEF SUMMARY OF THE INVENTION

The present invention provides a system and method for detecting anomalies in turbine engines emanating from the main shaft and/or main shaft bearings. The anomaly detection system includes a sensor data processor and a matrix analysis mechanism. The sensor data processor receives engine sensor data, including main engine speed data during spin down, and formats the engine sensor data into an appropriate matrix. The matrix analysis mechanism receives the sensor data matrix and performs a singular value analysis on the sensor data matrix to detect potential anomalies in the turbine engine main shaft and/or bearings. The output of the matrix analysis mechanism is passed to a diagnostic system where further evaluation of the anomaly detection determination can occur.

BRIEF DESCRIPTION OF DRAWINGS

The preferred exemplary embodiment of the present invention will hereinafter be described in conjunction with the appended drawings, where like designations denote like elements, and.

DETAILED DESCRIPTION OF THE INVENTION

The present invention provides a system and method for detecting anomalies in turbine engines emanating from the main shaft and/or main shaft bearings. Specifically, the system and method receives sensor data and uses matrix analysis on the sensor data to detect anomalies in the turbine engine(s).

Figure 1:
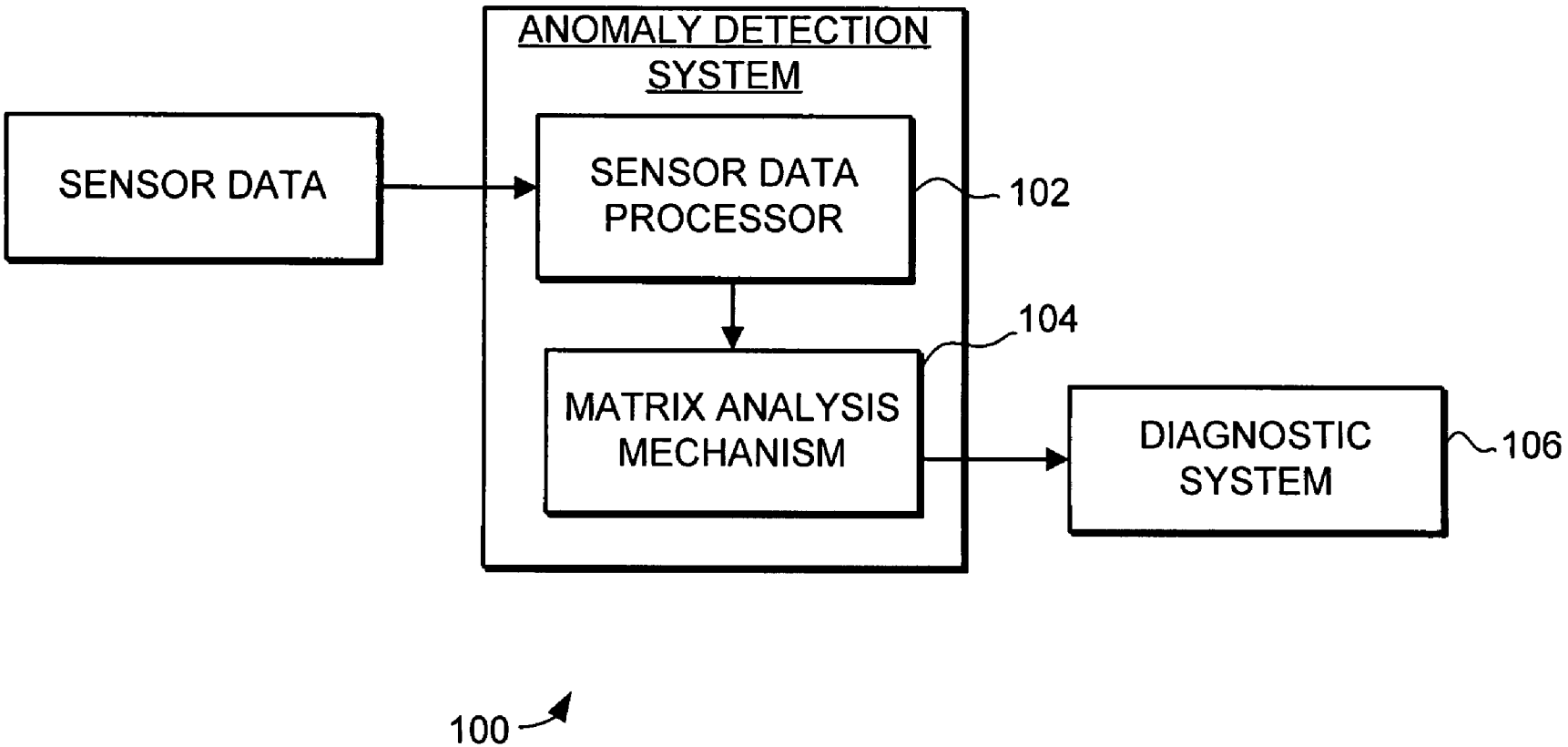
FIG. 1 is a schematic view of an anomaly detection system.

Turning now to FIG. 1, an exemplary anomaly detection system 100 is illustrated schematically. The anomaly detection system 100 includes a sensor data processor 102 and a matrix analysis mechanism 104. The sensor data processor 102 receives engine sensor data, including main engine speed data during spin down, and formats the engine sensor data into an appropriate matrix. The matrix analysis mechanism 104 receives the sensor data matrix and performs a singular value analysis on the sensor data matrix to detect potential anomalies in the turbine engine main shaft and/or bearings. The output of the matrix analysis mechanism 104 is passed to a diagnostic system 106 where further evaluation of the anomaly detection determination can occur.

Figure 2:
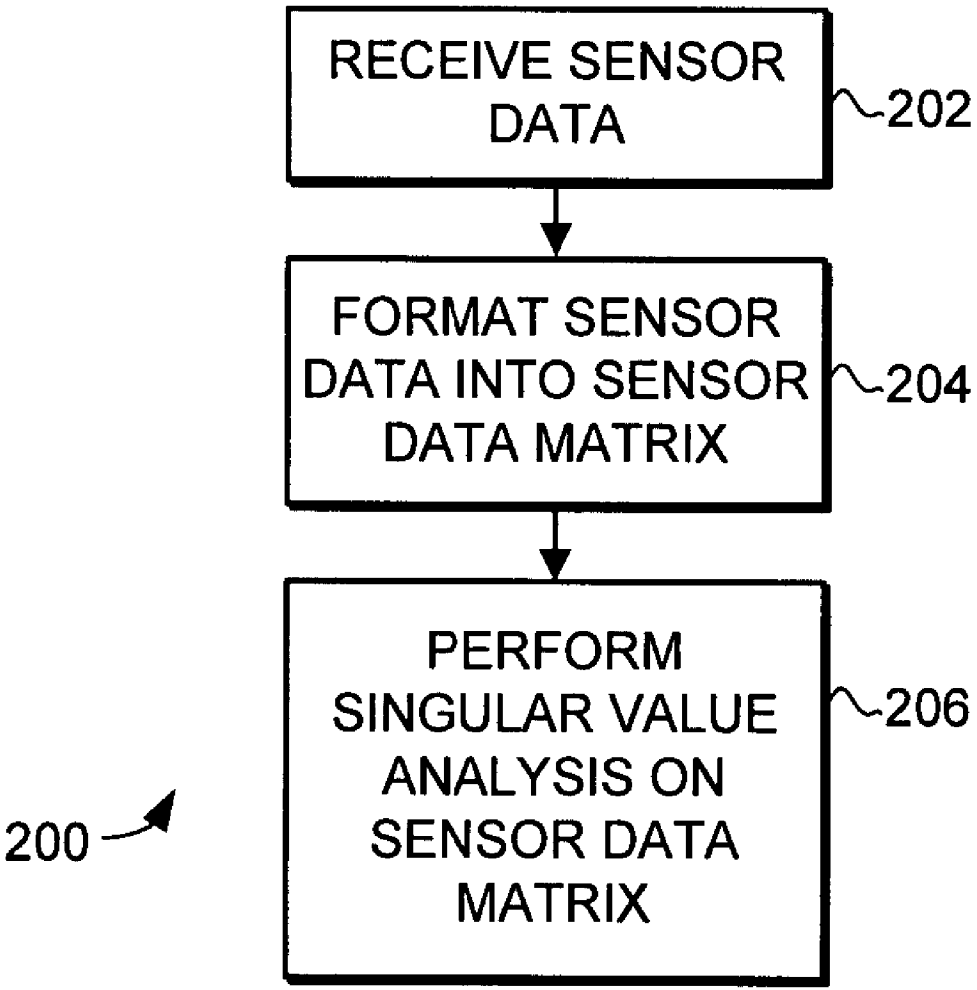
FIG. 2 is a flow diagram illustrating a turbine engine anomaly detection method.

Turning now to FIG. 2, a method 200 for turbine engine anomaly detection is illustrated. Method 200 lists the general steps that can be performed in an anomaly detection method using the embodiments of the present invention. The first step 202 is to receive sensor data from the turbine engine, with the sensor data providing the basis for the analysis and anomaly detection. In one embodiment, the sensor data comprises turbine engine speed data. Of course, the sensor data could also include other types of turbine engine data. Other types of data that could be used include exhaust gas temperature data, oil inlet pressure data, fan speed data, and vibration data.

As one more specific embodiment, the sensor data comprises main shaft speed measurements taken during turbine engine spin-down. In general, spin-down is the inertia driven rotation that occurs after the engine has been commanded to stop and fuel flow to the engine has been shut off. Specifically, after turbine engine fuel is shut off the inertia of the rotating main shaft keeps it turning. Friction forces cause the main shaft to decelerate until the inertia is completely overcome and the main shaft comes to a stop. This time between fuel flow cut off and the main shaft stopping is generally referred to as spin down.

Because the fuel flow has stopped and there are no other significant forces acting on the turbine engine, the main shaft rotation speed profile during spin down is highly indicative of the state of the main shaft and/or associated bearings. Generally, it is desirable to use data from a portion of the spin down time that is most indicative of the main shaft and/or associated bearings. For example, using a speed data from the time period when the main shaft rotation is between 40% of full speed to 10% of full speed is has been shown to especially effective in detecting anomalies in the main shaft and bearings. Thus, as one specific example, main shaft speed data measurements are taken starting at 40% of full speed at a specified rate until a desired number of measurements are taken or until the engine slows to a specified point, with the results provided as sensor data in step 202. Generally, measurements taken at a rate of 1 Hz are sufficient, but higher rates can be used where such higher rate of measurements are available. Again, the measurements taken during spin down can include other types of sensor data, including exhaust gas temperature data, oil inlet pressure data, fan speed data, and vibration data.

It should be noted that the sensor data received in step 202 can comprise data from one engine or from multiple engines. For example, the sensor data can comprise data taken from multiple engines on the same aircraft. In the alternative, the sensor data can comprise data taken from the same engine at multiple different occurrences. Finally, the sensor data could comprise a combination of measurements take from multiple engines at multiple different spin down occurrences. When the sensor data is taken from multiple engines, the matrix analysis is used to compare the data from different engines to detect anomalies in any of the engines. Conversely, when the sensor data is taken from a single engine during multiple occurrences, the matrix analysis compares the data from these different occurrences to detect anomalies in the engine supplying the sensor data.

The next step 204 is to format the sensor data into a sensor data matrix to facilitate a matrix analysis of the sensor data. The sensor data can be formatted into a sensor data matrix in a variety of ways. For example, where the sensor data includes a measurements from multiple engines, data for each engine can be placed in a corresponding row in the sensor data matrix. Thus, for a system with 4 engines and 50 sensor data measurements per engine, the sensor data can be formatted into the sensor data matrix by forming a 4×50 matrix with 4 rows and 50 columns, with each row thus corresponding to the data from one turbine engine.

In the alterative, when the sensor data comes from multiple occurrences formatting the sensor data into the sensor data matrix can comprise putting data for each occurrence into a corresponding row. For example, if sensor data comprises 60 measurements taken from six occurrences, the sensor data matrix can comprise and 6×60 with each row corresponding to one spin down occurrence of the turbine engine.

It should be noted that while the terms "row" and "column" have specific mathematical connotations terms with respect to matrices, that formatting and operations performed on data in a row could equivalently be formatted and performed on data on a column, and that the terms are thus to some extent interchangeable.

The next step 206 is to perform a singular value analysis on the sensor data matrix to detect potential anomalies in the turbine engine. In general, the singular value analysis is designed to compare sensor data from different engines and/or different occurrences to determine if an anomaly exists in a turbine engine. For example, the singular value analysis can be used to compare spin down performance of multiple turbine engines on the vehicle to determine if any one of the engines has a problem in the main shaft and/or associated bearings. Alternatively, the singular value analysis can be used to compare spin down performance of the same engine over multiple different occurrences to determine if a problem is developing in the main shaft and/or associated bearings. In all cases, the singular value analysis provides a mechanism for comparing how close the sensor data from multiple sets of data are and hence detect anomalies in that sensor data.

The step of performing a singular analysis on the sensor data matrix can be implemented with a variety of techniques and tools. For example, the singular analysis on the sensor data matrix can comprise first calculating a covariance matrix from the sensor data matrix. The covariance matrix can be calculated by multiplying the sensor data matrix by its transpose. Next, the singular values of the of the covariance matrix are calculated by any suitable technique. For example, the singular values can be calculated using a suitable QR decomposition technique for symmetric matrices. Of course, this is just one example of a technique that can be used for calculating the singular values of the matrix. Other techniques include iterative eigenvalue decomposition for solving polynomial equations. The resulting singular values are indicative of anomalies in the turbine engines.

Specifically, if the sensor data from each engine and/or each occurrence is substantially equivalent, then the covariance matrix will be very close to having a single rank, and all but the first singular values will be very close to zero. If on the other hand, one or more engines and/or occurrences have significant deviations, then the second singular value will be significantly greater. Thus, the singular value analysis can comprise calculating the singular values and comparing at least one of the singular values to a threshold value that is deemed to be indicative of problems in the main shaft and/or bearings. For example, if the second singular value exceeds a threshold value then it is determined that a potential problem with the main shaft and/or bearings exists, and should be examined by a technician.

The threshold value used would depend on a variety of factors. Although in theory spin down profiles from multiple engines or multiple occurrences of the same engine are similar, the rank of the resulting covariance matrix may be slightly greater than one. Consequently, the second singular value will not be exactly zero and hence one needs to set a non-zero threshold. Typically, the threshold value would be empirically derived from past experience to determine what levels of singular values are likely to be indicative problems. The lower the threshold value, the earlier such problems would be detected, at the cost of an increased number of false positives. Likewise, a higher threshold value is more likely to accurately indicate problem, at the cost of a later diction of the problems.

Figure 3:
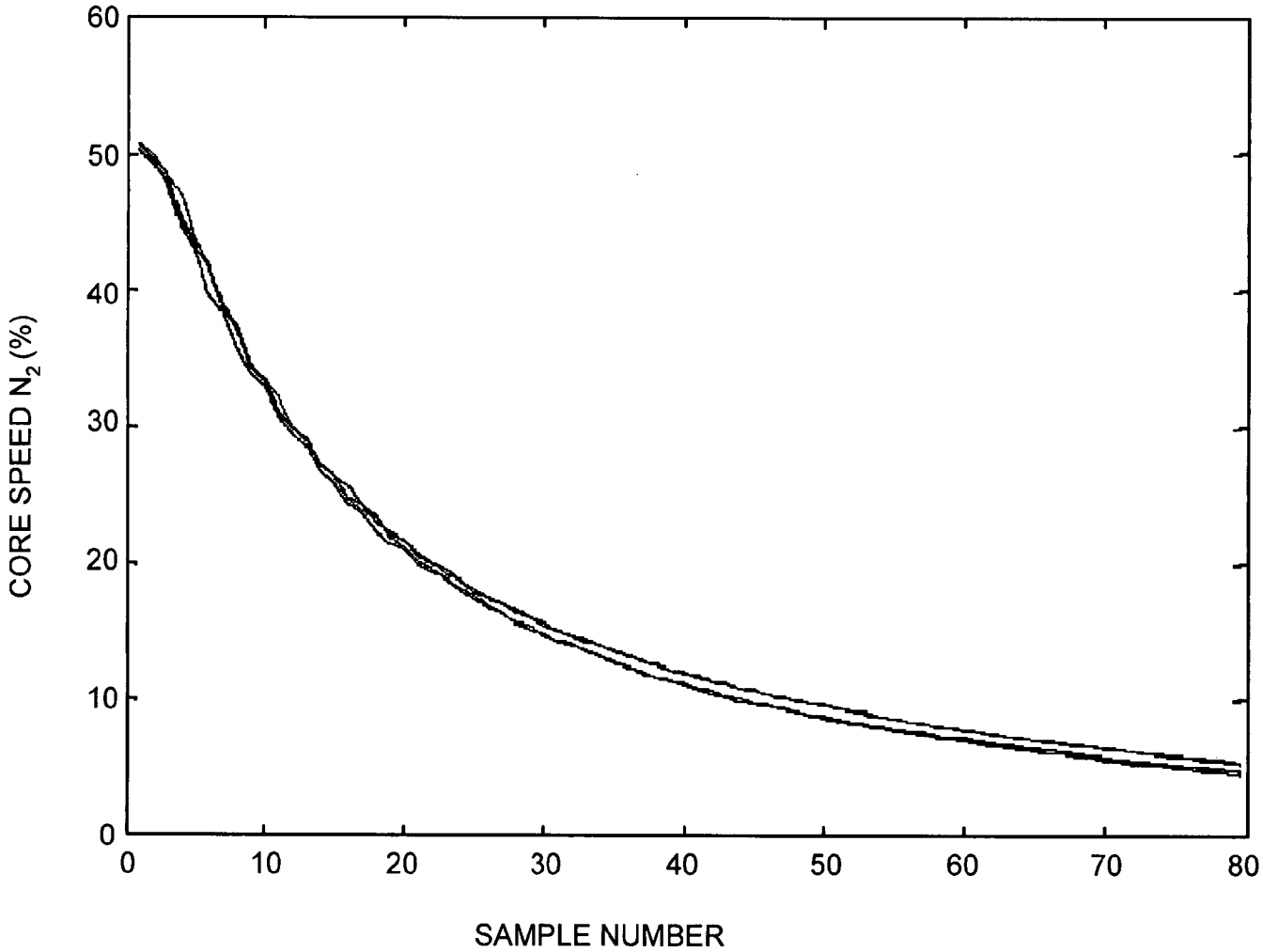
FIG. 3 is a graph illustrating exemplary main shaft speed sensor data taken from four engines during spin down.

A detailed example of an anomaly detection procedure using exemplary data sets will be given. Turning now to FIG. 3, a graph 300 illustrates exemplary main shaft speed sensor data taken from four engines during spin down. As can be seen in FIG. 3, after fuel flow is cut off, the engines decelerate as friction overwhelms the inertia of the engine.

As discussed above, in the preferred system and method of anomaly detection, at least a portion of the sensor data taken during engine spin down is formatted into an appropriate sensor data matrix. Again, the portion of sensor data is preferably selected to be that portion that is most indicative of anomalies in the turbine engine. For example, the portion can be defined as a selected set of sensor data taken from each engine over a range of rotational speeds. Selecting the portion of sensor data used for each engine independently compensates for any differences in the start of the spin down between individual engines or individual occurrences.

In the example of the data illustrated in FIG. 3, the portion can be defined as a specified number of samples (m), at a specified rate and beginning at a defined starting point in the spin down process for each of the four engines $N_1$-$N_4$. For example, starting at 40% of full engine speed and taking 80 samples at 1 Hz will define a portion of sensor data from each engine down to about 10% of full engine speed, and thus will cover the range of engine speed that has been shown to be highly indicative of main shaft and bearing related anomalies.

The m samples taken from four engines $N_1$-$N_4$ can be formatted into a matrix NN defined as:

$$NN = \begin{bmatrix} N_1(1) & N_1(2) & \dots & N_1(m-1) & N_1(m) \\ N_2(1) & N_2(2) & \dots & N_2(m-1) & N_2(m) \\ N_3(1) & N_3(2) & \dots & N_3(m-1) & N_3(m) \\ N_4(1) & N_4(2) & \dots & N_4(m-1) & N_4(m) \end{bmatrix} \quad (1.)$$

In the case where all four engines are operating correctly, the data from all four engines would be very close, and the matrix defined in equation 1 would only one independent row, and hence the rank of the matrix NN would be very close to 1. If, on the other hand, one of the engines is experiencing anomalies in its main shaft and/or bearings, these anomalies will manifest themselves in the form a higher rank in the matrix. A computational tractable way of calculating the rank of the matrix is to use a singular value decomposition of the covariance matrix. The covariance matrix covNN can be defined as:

$$\text{cov}NN = \frac{1}{m-1} NN^T \times NN \quad (2.)$$

Where $NN^T$ is the transpose of the matrix NN. In the example of equation 1 with data from four engines, the covariance matrix covNN will be a 4×4 matrix with up to four non-zero singular values. Likewise, where the data is from six spin down occurrences of the same engine, the covariance matrix covNN will be a 6×6 matrix with up to six non-zero singular values.

The singular values of the covariance matrix covNN can be calculated using any suitable technique. For example, they can be calculated using a tool such as the MATLAB command sigma_N=svd(NN), available in the MATLAB toolkit.

With the singular values calculated they can be analyzed by comparing the singular values to a threshold value. As stated above, when an anomaly is present in the turbine engines, the second singular value of the covariance matrix will increase. The larger the anomaly, the greater the second singular value will be. Thus by analyzing the second singular value, the system and method can determine the presence of anomalies.

Figure 4:
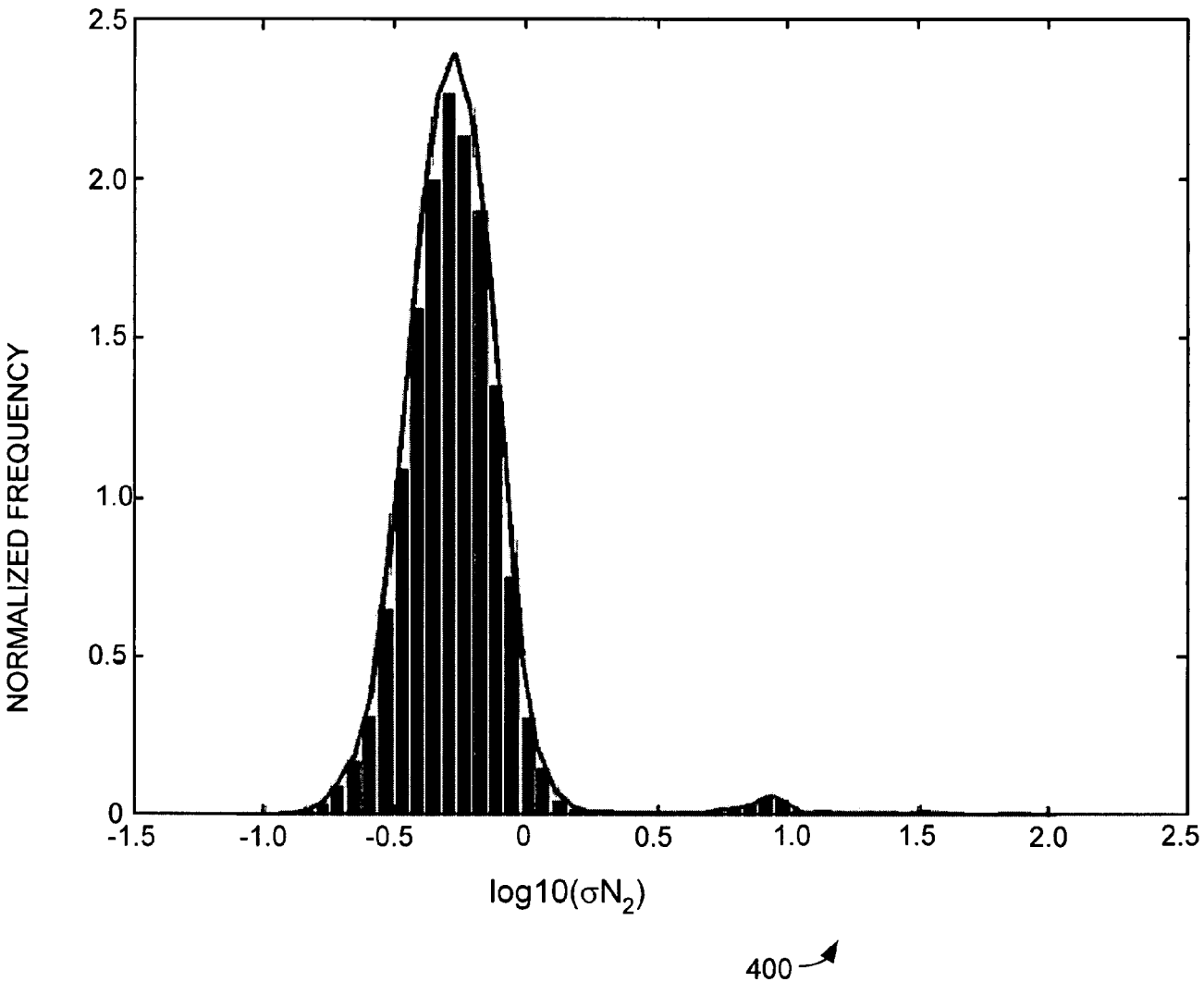
FIG. 4 is a graph illustrating a histogram of the logarithm of the second singular value calculated from a set of flights.

One specific technique for determining the threshold value to use in this comparison is to examine historical data from many different sources. Turning now to FIG. 4, a histogram 400 of the logarithm of the second singular value calculated from a set of flights is illustrated. The logarithm of the second singular value is used to detect orders of magnitude change in the singular values. The histogram 400 shows how a set of historical data can be used to determine an appropriate threshold. Specifically, the histogram 400 shows that for good turbine engines, the logarithm of the second singular value consistently less than or equal to 0, whereas the smaller peak at 1 indicates the logarithm of the second singular value is greater than or equal to 1 for engines with bearing problems. Thus, 1 can serve as a threshold value for the logarithm of the second singular value. Thus, setting the threshold value for the logarithm of the second singular value using experimental data can provide good predictability of anomalies in the turbine engines.

To avoid the effects of noise in the system, it is also generally preferable to require that the second singular value exceed the threshold value on more than one consecutive occasion before an alert is given to the diagnostic or control system. For example, the system can be designed to provide an alert to the system when the second singular value has exceeded the threshold value on five consecutive occurrences. This minimizes the change of noise causing a false alert to the system while providing good predictability.

Figure 5:
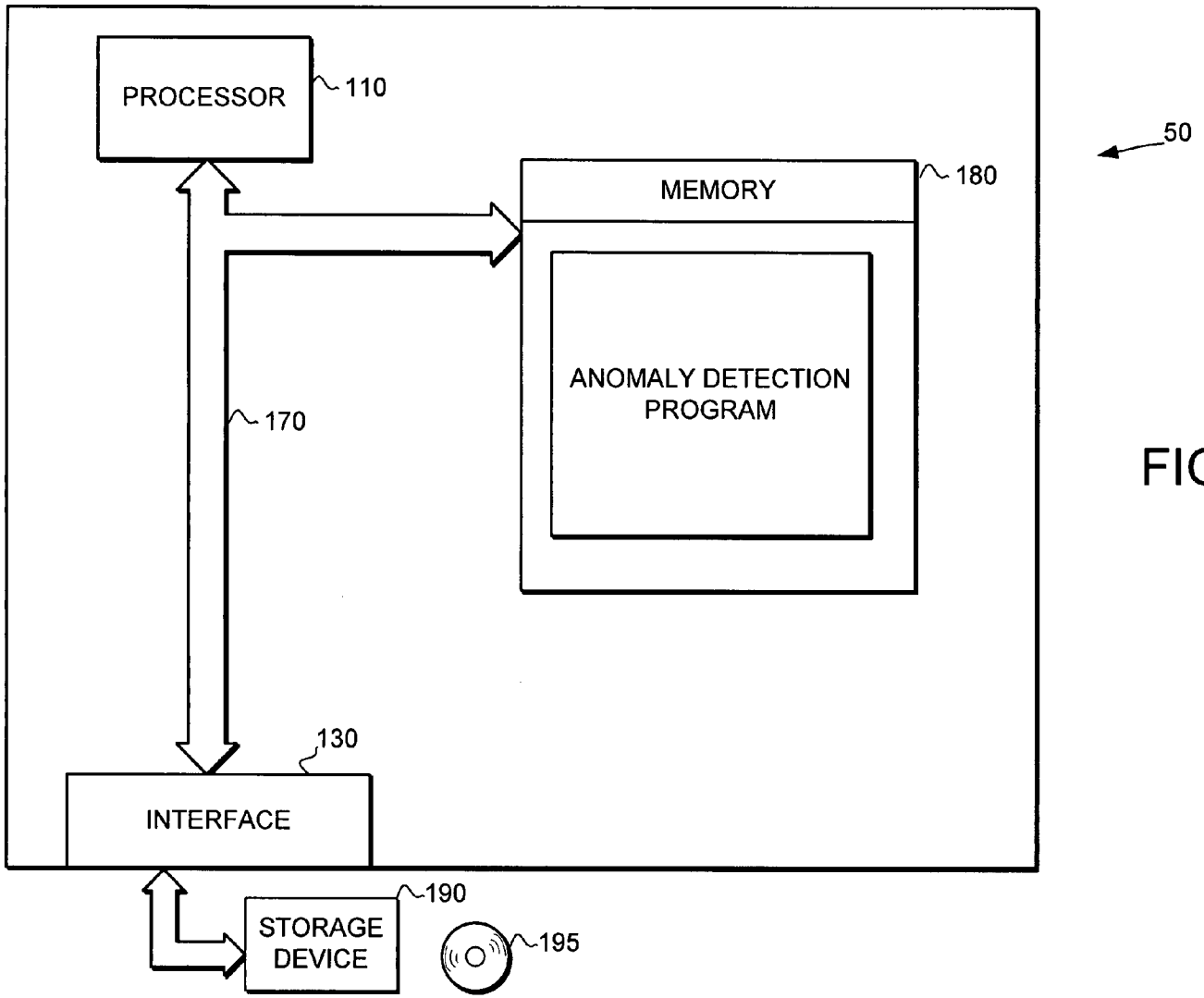
FIG. 5 is a schematic view of an exemplary computer system implementing an anomaly detection system.

The anomaly detection system and method can be implemented in wide variety of platforms. Turning now to FIG. 5, an exemplary computer system 50 is illustrated. Computer system 50 illustrates the general features of a computer system that can be used to implement the invention. Of course, these features are merely exemplary, and it should be understood that the invention can be implemented using different types of hardware that can include more or different features. It should be noted that the computer system can be implemented in many different environments, such as onboard an aircraft to provide onboard diagnostics, or on the ground to provide remote diagnostics. The exemplary computer system 50 includes a processor 110, an interface 130, a storage device 190, a bus 170 and a memory 180. In accordance with the preferred embodiments of the invention, the memory system 50 includes an anomaly detection program, which includes a sensor data processor and a matrix analysis mechanism.

The processor 110 performs the computation and control functions of the system 50. The processor 110 may comprise any type of processor, include single integrated circuits such as a microprocessor, or may comprise any suitable number of integrated circuit devices and/or circuit boards working in cooperation to accomplish the functions of a processing unit. In addition, processor 110 may comprise multiple processors implemented on separate systems. In addition, the processor 110 may be part of an overall vehicle control, navigation, avionics, communication or diagnostic system. During operation, the processor 110 executes the programs contained within memory 180 and as such, controls the general operation of the computer system 50.

Memory 180 can be any type of suitable memory. This would include the various types of dynamic random access memory (DRAM) such as SDRAM, the various types of static RAM (SRAM), and the various types of non-volatile memory (PROM, EPROM, and flash). It should be understood that memory 180 may be a single type of memory component, or it may be composed of many different types of memory components. In addition, the memory 180 and the processor 110 may be distributed across several different computers that collectively comprise system 50. For example, a portion of memory 180 may reside on the vehicle system computer, and another portion may reside on a ground based diagnostic computer.

The bus 170 serves to transmit programs, data, status and other information or signals between the various components of system 100. The bus 170 can be any suitable physical or logical means of connecting computer systems and components. This includes, but is not limited to, direct hard-wired connections, fiber optics, infrared and wireless bus technologies.

The interface 130 allows communication to the system 50, and can be implemented using any suitable method and apparatus. It can include a network interfaces to communicate to other systems, terminal interfaces to communicate with technicians, and storage interfaces to connect to storage apparatuses such as storage device 190. Storage device 190 can be any suitable type of storage apparatus, including direct access storage devices such as hard disk drives, flash systems, floppy disk drives and optical disk drives. As shown in FIG. 5, storage device 190 can comprise a disc drive device that uses discs 195 to store data.

In accordance with the preferred embodiments of the invention, the computer system 50 includes an anomaly detection program. Specifically during operation, the anomaly detection program is stored in memory 180 and executed by processor 110. When being executed by the processor 110, anomaly detection program receives sensor data and determines the likelihood of anomaly using the sensor data processor and the matrix analysis mechanism.

As one example implementation, the anomaly detection system can operate on data that is acquired from the mechanical system (e.g., aircraft) and periodically uploaded to an internet website. The analysis is performed by the web site and the results are returned back to the technician or other user. Thus, the system can be implemented as part of a web-based diagnostic and prognostic system.

As another example, the anomaly detection system can operate on board the aircraft, as part of the on-board diagnostic and fault detection system. In this case the sensor data is stored and processed on board to provide a warning when an anomaly is detected in the system.

It should be understood that while the present invention is described here in the context of a fully functioning computer system, those skilled in the art will recognize that the mechanisms of the present invention are capable of being distributed as a program product in a variety of forms, and that the present invention applies equally regardless of the particular type of signal bearing media used to carry out the distribution. Examples of signal bearing media include: recordable media such as floppy disks, hard drives, memory cards and optical disks (e.g., disk 195), and transmission media such as digital and analog communication links, including wireless communication links.

The present invention thus provides a system and method for detecting anomalies in turbine engines emanating from the main shaft and/or main shaft bearings. The anomaly detection system includes a sensor data processor and a matrix analysis mechanism. The sensor data processor receives engine sensor data, including main engine speed data during spin down, and formats the engine sensor data into an appropriate matrix. The matrix analysis mechanism receives the sensor data matrix and performs a singular value analysis on the sensor data matrix to detect potential anomalies in the turbine engine main shaft and/or bearings. The output of the matrix analysis mechanism is passed to a diagnostic system where further evaluation of the anomaly detection determination can occur.

The embodiments and examples set forth herein were presented in order to best explain the present invention and its particular application and to thereby enable those skilled in the art to make and use the invention. However, those skilled in the art will recognize that the foregoing description and examples have been presented for the purposes of illustration and example only. The description as set forth is not intended to be exhaustive or to limit the invention to the precise form disclosed. Many modifications and variations are possible in light of the above teaching without departing from the spirit of the forthcoming claims.

The invention claimed is:

1. An anomaly detection system for detecting anomalies in a plurality of turbine engines, the anomaly detection system comprising:

a sensor data processor, the sensor data processor adapted to receive engine sensor data from the plurality of turbine engines and format the engine sensor data into a sensor data matrix, where the sensor data matrix of engine sensor data comprises a multi-dimensional array with rows and columns; and a matrix analysis mechanism, the matrix analysis mechanism adapted to perform a singular value analysis on the sensor data matrix to compare the sensor data from plurality of turbine engines and detect potential anomalies in the plurality of turbine engines, and wherein the anomaly detection system is further adapted to generate a notification of detected potential anomalies in the plurality of turbine engines.

2. The system of claim 1 wherein the sensor data processor formats the sensor data into the sensor data matrix by placing sensor data from each of the plurality of turbine engines into a corresponding row in the sensor data matrix.

3. The system of claim 1 wherein the sensor data includes data from multiple spin down occurrences taken after fuel flow has been shut off, and wherein the sensor data processor formats the sensor data into the sensor data matrix by placing sensor data from each of the multiple spin down occurrences into a corresponding row in the sensor data matrix.

4. The system of claim 1 wherein the sensor data comprises main shaft speed data.

5. The system of claim 1 wherein the sensor data comprises main shaft speed data taken during turbine engine spin-down, wherein engine spin-down occurs for each turbine engine after fuel flow has been shut off.

6. The system of claim 1 wherein the matrix analysis mechanism is adapted to perform a singular value analysis on the sensor data matrix to detect potential anomalies in the plurality of turbine engines by calculating a singular value from the sensor data and comparing the singular value to a threshold value.

7. The system of claim 1 wherein the matrix analysis mechanism is adapted to perform a singular value analysis on the sensor data matrix to detect potential anomalies in the plurality of turbine engines by calculating a covariance matrix from the sensor data matrix and by calculating at least a second singular value from the covariance matrix and comparing the second singular value to a threshold value.

8. The system of claim 5 wherein the main shaft speed data taken during turbine engine spin-down comprises data collected from the plurality of turbine engines between two defined main shaft speeds after the fuel flow has been shut off.

9. The system of claim 6 wherein the matrix analysis mechanism calculates the singular value using a QR decomposition for symmetric matrices.

10. The system of claim 7 wherein the notification of detected potential anomalies is made after a predetermined number of successive second singular values exceed the threshold value.

11. A method of detecting anomalies in a plurality of turbine engines, the method comprising the steps of:

a) receiving sensor data from the plurality of turbine engines;

b) formatting the sensor data into a sensor data matrix, where the sensor data matrix of sensor data comprises a multi-dimensional array with rows and columns;

c) performing a singular value analysis on the sensor data matrix to compare the sensor data from the plurality of turbine engines and detect potential anomalies in the plurality of turbine engines; and d) generating a notification of detected potential anomalies in the plurality of turbine engines.

12. The method of claim 11 wherein the step of formatting the sensor data into the sensor data matrix comprises placing the sensor data from each of the plurality of turbine engines into a corresponding row in the sensor data matrix.

13. The method of claim 11 wherein the sensor data includes sensor data from multiple spin down occurrences taken after fuel flow has been shut off, and wherein the step of formatting the sensor data into the sensor data matrix comprises placing sensor data from each of the multiple spin down occurrences into a corresponding row in the sensor data matrix.

14. The method of claim 11 wherein the sensor data comprises main shaft speed data.

15. The method of claim 11 wherein the sensor data comprises main shaft speed data taken during turbine engine spin-down, wherein engine spin-down occurs for each turbine engine after fuel flow has been shut off.

16. The method of claim 11 wherein the step of performing a singular value analysis on the sensor data matrix to compare the sensor data from the plurality of turbine engines and detect potential anomalies in the plurality of turbine engines comprises calculating a singular value from the sensor data and comparing the singular value to a threshold value.

17. The method of claim 11 wherein the step of performing a singular value analysis on the sensor data matrix to compare the sensor data from the plurality of turbine engines and detect potential anomalies in the plurality of turbine engines comprises calculating a covariance matrix from the sensor data matrix and calculating at least a second singular value from the covariance matrix and comparing the second singular value to a threshold value.

18. The method of claim 15 wherein the main shaft speed data taken turbine engine spin-down comprises data collected from the plurality of turbine engines between two defined main shaft speeds after the fuel flow has been shut off.

19. The method of claim 16 wherein the step of calculating a singular value from the sensor data comprises using a QR decomposition for symmetric matrices.

20. The method of claim 17 wherein the step of generating a notification of detected potential anomalies in the plurality of turbine engines comprises generating notification after a predetermined number of successive second singular values exceed the threshold value.

21. A program product comprising:

a) an anomaly detection program, the anomaly detection program including:

a sensor data processor, the sensor data processor adapted to receive engine sensor data from a plurality of turbine engines and format the engine sensor data into a sensor data matrix, where the sensor data matrix of engine sensor data comprises a multi-dimensional array with rows and columns; and a matrix analysis mechanism, the matrix analysis mechanism adapted to perform a singular value analysis on the sensor data matrix to compare the sensor data from plurality of turbine engines and detect potential anomalies in the plurality of turbine engines, and wherein the anomaly detection program is further adapted to generate a notification of detected potential anomalies in the plurality of turbine engines; and b) computer-readable signal bearing media bearing said anomaly detection program.

22. The program product of claim 21 wherein the sensor data processor formats the sensor data into the sensor data matrix by placing sensor data from each of the plurality of turbine engines into a corresponding row in the sensor data matrix.

23. The program product of claim 21 wherein the sensor data includes data from multiple spin down occurrences taken after fuel flow has been shut off, and wherein the sensor data processor formats the sensor data into the sensor data matrix by placing sensor data from each of the multiple spin down occurrences into a corresponding row in the sensor data matrix.

24. The program product of claim 21 wherein the sensor data comprises main shaft speed data.

25. The program product of claim 21 wherein the sensor data comprises main shaft speed data taken during turbine engine spin-down, wherein engine spin-down occurs for each turbine engine after fuel flow has been shut off.

26. The program product of claim 21 wherein the matrix analysis mechanism is adapted to perform a singular value analysis on the sensor data matrix to detect potential anomalies in the plurality of turbine engines by calculating a singular value from the sensor data and comparing the singular value to a threshold value.

27. The program product of claim 21 wherein the matrix analysis mechanism is adapted to perform a singular value analysis on the sensor data matrix to detect potential anomalies in the plurality of turbine engines by calculating a covariance matrix from the sensor data matrix and by calculating at least a second singular value from the covariance matrix and comparing the second singular value to a threshold value.

28. The program product of claim 25 wherein the main shaft speed data taken during turbine engine spin-down comprises data collected from the plurality of turbine engines between two defined main shaft speeds after the fuel flow has been shut off.

29. The program product of claim 26 wherein the matrix analysis mechanism calculates the singular value using a QR decomposition for symmetric matrices.

30. The program product of claim 27 wherein the notification of detected potential anomalies is made after a predetermined number of successive second singular values exceed the threshold value.

* * * * *